US007152696B2

(12) United States Patent
Jones

(10) Patent No.: US 7,152,696 B2
(45) Date of Patent: Dec. 26, 2006

(54) METHOD AND CONTROL SYSTEM FOR DIRECTIONAL DRILLING

(75) Inventor: Franklin B. Jones, Shrewsbury, MA (US)

(73) Assignee: Comprehensive Power, Inc., Marlborough, MA (US)

( * ) Notice: Subject to any disclaimer, the term of this patent is extended or adjusted under 35 U.S.C. 154(b) by 0 days.

(21) Appl. No.: 11/252,481

(22) Filed: Oct. 18, 2005

(65) Prior Publication Data

US 2006/0081399 A1 Apr. 20, 2006

Related U.S. Application Data

(60) Provisional application No. 60/620,504, filed on Oct. 20, 2004.

(51) Int. Cl.
*E21B 7/04* (2006.01)

(52) U.S. Cl. ..... 175/61; 175/40; 175/73

(58) Field of Classification Search ..... 175/61, 175/73, 40, 24
See application file for complete search history.

(56) References Cited

U.S. PATENT DOCUMENTS 5,465,799 A 11/1995 Ho
6,050,348 A 4/2000 Richardson et al.
6,719,069 B1 * 4/2004 Alft et al. ..... 175/24
6,802,378 B1 10/2004 Haci et al.
6,918,453 B1 7/2005 Haci et al.
2002/0104685 A1 8/2002 Pinckard et al.
2004/0118612 A1 * 6/2004 Haci et al. ..... 175/61

* cited by examiner

*Primary Examiner*—Hoang Dang
(74) *Attorney, Agent, or Firm*—Guerin & Rodriguez, LLP; William G. Guerin

(57) ABSTRACT

A method and control system for directional drilling are described. A drill string motor is commanded to rotate at a constant speed in a forward direction and the constant speed in a reverse direction for a first duration and a second duration, respectively, for at least one oscillation cycle. The difference between an averaged absolute angle of the drill string and a target rotation angle for the drill string is maintained near zero by adjusting the length of the durations as necessary. The target rotation angle can be changed based on measurement while drilling data obtained during drilling operations. Advantageously, friction between the drill string and bore hole is reduced, leading to an increase in the drilling penetration rate.

16 Claims, 5 Drawing Sheets

METHOD AND CONTROL SYSTEM FOR DIRECTIONAL DRILLING

CROSS-REFERENCE TO RELATED APPLICATION

This application claims the benefit of the filing date of co-pending U.S. provisional patent application Ser. No. 60/620,504, filed Oct. 20, 2004, titled "Method and Apparatus for Directional Drilling," the entirety of which provisional application is incorporated by reference herein.

FIELD OF THE INVENTION

The invention relates generally to a method and apparatus for directional drilling. In particular, the invention relates to a method and apparatus for oscillatory control of a drill string used for subterranean drilling.

BACKGROUND

Subterranean drilling is an expensive process during which a bore hole is drilled through the earth to gain access to a desired resource such as an oil or gas deposit. Many drilling operations employ directional drilling, especially when the target deposit is located laterally thousands of feet from the drilling rig. The length of the bore hole required to reach the deposit is determined by the depth and lateral displacement of the deposit from the drilling rig.

The drilling process typically involves rotating a drill bit with a downhole motor at a remote end of a string of drill pipe or "drill string." The rotating bit bores through underground formations, opening a path for the drill string. Drilling fluid forced through the drill string powers the downhole motor. Directional drilling is used to steer the motor and bit from a straight drill path in any inclination and azimuthal orientation, and allows an operator to guide the bore hole to the target deposit. For example, to access an underground deposit, the operator can drill a vertical bore hole from the drilling rig. The operator then steers the downhole motor and drill bit to drill a deflected continuation of the bore hole to reach and penetrate the deposit. In some instances, the bore hole can have one or more substantially horizontal sections including where the bore hole penetrates the deposit.

Significant friction can exist between the bore hole and the drill string. Friction generally slows the drilling process by reducing the force applied to the drill bit. Friction is most significant where the drill string is forced against the bore hole such as in regions where the bore hole is substantially horizontal. During straight path drilling, the drill string is continuously rotated in a single direction about its longitudinal axis to reduce the effect of friction and increase the penetration rate.

Directional drilling is typically accomplished by orienting the toolface of the drilling bit in the desired direction and maintaining the orientation. To start directional drilling, the continuous rotation of the drill string is terminated and the operator determines the current toolface orientation, for example, by measuring the toolface orientation using "measurement while drilling" (MWD) sensors. The drill string is then rotated to change the direction of the toolface to a desired direction for subsequent drilling of the bore hole.

Directional drilling is often performed at the end of a drill string that is several thousand feet in length. Although change of the bore hole direction is typically accomplished through a gradual deflected over hundreds of feet or more so that the drill string bends gradually, the friction between the drill string and the bore hole generally increases. In addition, the drill string is elastic and stores torsional tension like a spring. Consequently, when an operator makes a static angle adjustment to the drill string at the drilling rig to change the toolface orientation, a substantial portion of the angle adjustment is "absorbed" by the friction without changing the toolface orientation. Thus the drill string can require more rotation at the surface than the desired rotation of the toolface.

Similar to straight path drilling, the rate of penetration during directional drilling is adversely affected by friction between the drill string and bore hole. To reduce frictional limitation of the penetration rate, the drill string can alternate between rotation in forward (e.g., clockwise) and reverse (e.g., counterclockwise) directions. Due to the torsional spring properties of the drill string, the rotation of the drill string at the surface does not match the rotation of the drill string at other positions along its length. More specifically, the rotation of the drill string decreases with distance from the drilling rig. If the amount of rotation imparted at the surface is properly limited, the drill string will not rotate at the downhole motor. Thus the frictional limitation on the drilling process can be reduced by back and forth rotation of the surface portion of the drill string within appropriate angular limits without changing the orientation of the toolface although in practice it can be difficult to achieve the desired back and forth rotation without affecting the orientation of the toolface during directional drilling.

Thus, there remains a need for a method of directional drilling that overcomes the above described problems. The method of the current invention satisfies this need and provides additional advantages.

SUMMARY OF THE INVENTION

In one aspect, the invention features a method for reducing friction in a bore hole during directional drilling. A drill string motor is commanded to rotate at a constant speed in a forward direction and the constant speed in a reverse direction for a first duration and a second duration, respectively, for at least one oscillation cycle such that an averaged absolute angle of the drill string is substantially the same as a target rotation angle. In one embodiment, the target rotation angle for the drill string is modified in response to measurement while drilling (MWD) data. In another embodiment, the averaged absolute angle of the drill string is determined for at least one oscillation cycle, the difference between the averaged absolute angle and the target rotation angle is determined, and the first and second durations are adjusted in response to the difference. The drill string motor is commanded to rotate at the constant speed in the forward direction and the reverse direction for the adjusted first duration and the adjusted second duration, respectively, for at least one subsequent oscillation cycle.

In another aspect, the invention features a control system for directional drilling. The control system includes a rotation sensor, an absolute angle estimator, an oscillation control module and an operator control panel. The rotation sensor provides rotation data in response to a rotation angle of a drill string. The absolute angle estimator communicates with the rotation sensor to receive rotation data and determine an absolute rotation angle of the drill string. The oscillation control module includes a closed loop speed controller and communicates with the absolute angle estimator. The oscillation control module commands the drill string motor to rotate at a constant speed in a forward direction and the constant speed in a reverse direction for a first duration and a second duration, respectively, for at least one oscillation cycle. The operator control panel communicates with the oscillation control module and is adapted to receive MWD data. The operator control panel has at least one user input device for an operator to adjust the first duration and the second duration for at least one subsequent oscillation cycle.

In still another aspect, the invention features a control system for directional drilling. The control system includes a rotation sensor, an absolute angle estimator, an error module and an oscillation control module. The rotation sensor provides rotation data in response to a rotation angle of a drill string. The absolute angle estimator communicates with the rotation sensor to receive rotation data and determine an absolute rotation angle of the drill string. The error module is configured to receive a target rotation angle and to receive MWD data indicating the orientation of a toolface of a drilling tool. The error module generates an error signal in response to a difference between the target rotation angle and the MWD data. The oscillation control module communicates with the absolute angle estimator and the error module, and includes a closed loop speed controller. The oscillation control module commands the drill string motor to rotate at a constant speed in a forward direction and the constant speed in a reverse direction for a first duration and a second duration, respectively, for at least one oscillation cycle. The first duration and the second duration are responsive to the error signal.

BRIEF DESCRIPTION OF THE DRAWINGS

The above and further advantages of this invention may be better understood by referring to the following description in conjunction with the accompanying drawings, in which like numerals indicate like structural elements and features in the various figures. The drawings are not necessarily to scale, emphasis instead being placed upon illustrating the principles of the invention.

DETAILED DESCRIPTION

In brief overview, the present invention relates to a method and control system for directional drilling. The method includes commanding a motor to rotate a drill string at a constant speed in a forward direction and at the same constant speed in a reverse direction for a first duration and a second duration, respectively. The durations can be adjusted to achieve or maintain the desired orientation of a drilling tool based, for example, on "measurement while drilling" (MWD) data. Advantageously, the method reduces the effects of friction in a bore hole, leading to an increase in the penetration rate.

Figure 1:
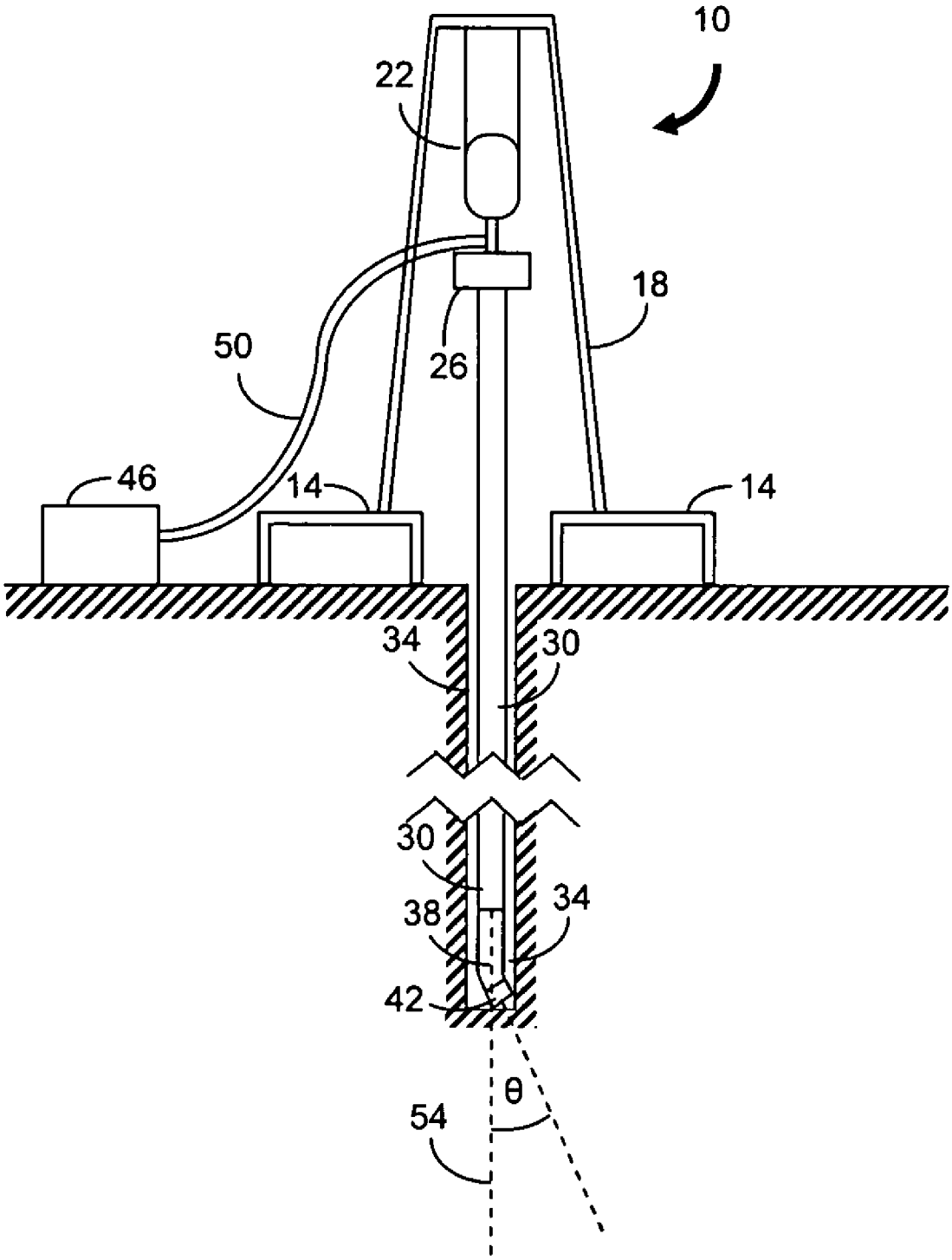
FIG. 1 is an illustration of a well having a vertical bore hole.

Referring to FIG. 1, a land-based drilling rig 10 includes a platform 14 and derrick 18. Lifting gear 22 attached to the derrick 18 provides for vertical positioning of a top drive 26. The top drive 26 supports and rotates a drill string 30 which extends along the length of a bore hole 34. The drill string 30 includes any number of coupled sections of drill pipe such as threaded steel pipe. A downhole motor 38 (e.g., mud motor) and drilling tool 42 are coupled to the remote end of the drill string 30 and are used to bore through formations to extend the bore hole 34. One or more mud pumps 46 deliver fluid through a hose 50 to the drill string 30. The fluid is conducted through the drill string 30 to the downhole motor 38 to rotate the drilling tool 42.

Significant friction occurs where the drill string 30 is forced against the bore hole 34. Friction generally slows the penetration rate by reducing the force applied to the drilling tool 42. To reduce the friction and thereby reduce the penetration time, the top drive 26 continuously rotates the drill string 30 in a single direction about its longitudinal axis 54. Normally, continuously rotating the drill string 30 while the drilling tool 42 is powered results in a straight bore hole 34 as shown in FIG. 1. The toolface of the drilling tool 42 defines a non-zero angle $\theta$ with respect to the axis 54 of the drill string 30. For example, the angle $\theta$ can be 1.5° but is shown in the figure as a substantially larger angle for clarity. Thus continous rotation results in a bore hole 34 having a larger diameter than would otherwise occur if the toolface angle $\theta$ were zero.

Figure 2:
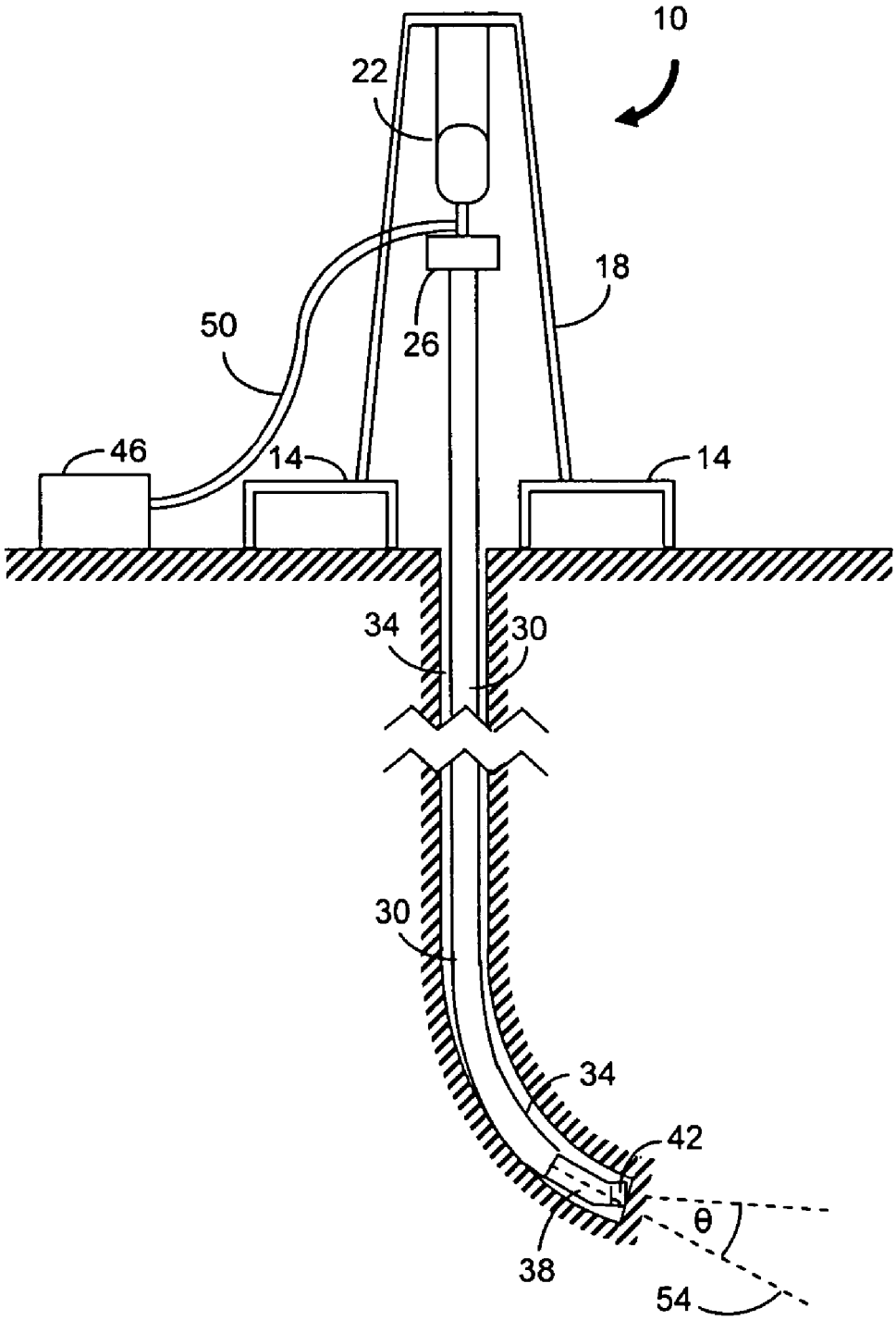
FIG. 2 is a an illustration of a well having a bore hole generated using directional drilling.

FIG. 2 shows the deviation of the bore hole 34 from a straight path achieved by directional drilling. To properly steer the motor 38 and tool 42, an operator terminates rotation of the drill string 30 and determines the toolface orientation, for example, by monitoring data from MWD sensors. The operator then rotates the drill string 30 through a certain angle to achieve the toolface orientation for the new drilling direction. As the drill string 30 is held still, the drilling tool 42 proceeds at the angle $\theta$ from the end of the drill string 30. Thus the bore hole 34 advances with a slightly narrower diameter along a curved path. A straight path can again be drilled by resuming continuous rotation of the drill string 30.

The drill string 30 acts as a torsional spring with properties determined in part from the string length and stiffness. When the top drive 26 rotates, the drill string 30 typically "twists" significantly along its length before the end of the drill string 30 at the downhole motor 38 starts to rotate. The amount of rotation at the top drive 26 necessary to achieve rotation at the downhole motor 38 also varies according to the reactive torque imparted along the length of the drill string 30.

Directional drilling can introduce substantial horizontal components to the bore hole 34 and, therefore, increases friction compared with a straight bore hole. Thus rotation of the drill string 30 to reduce frictional effects is of increased importance during dirctional drilling. Importantly, however, no rotation of the drill string 30 at the end coupled to the downhole motor 38 is desired once the proper toolface orieintation is established. Preferably, the top drive 26 rotates the drill string 30 in a back and forth (oscillatory) manner so that the drill string 30 at the rig 10 rotates but the drill string 30 at the downhole motor 38 does not rotate. As a result, the toolface orientation remains unchanged while frictional effects are substantially reduced. The oscillation of the drill string 30 at the top drive 26 should not exceed a certain angular range, i.e., oscillation magnitude, to ensure that the toolface orientation is unchanged. MWD sensors can be used to confirm that the rotation does not exceed the acceptable magnitude.

One prior technique for performing directional drilling to address the above described problems includes programming a computer with a desired pair of terminal angles. Torque applied by a motor rotates the drill string 30 back and forth between the terminal angles. Sensors monitored by the computer determine when the drill string rotation reaches either terminal angle so that the torque can be changed at the proper time. This known approach has not been widely adpted in practice and most operators still use manual methods for direction drilling. Moreover, no speed control is utilized therefore the drill string 30 does not turn if sufficient torque is not applied to overcome the friction between the drill string 30 and the bore hole 34. If necessary, an operator manually adjusts a pressure relief valve for a hydraulic motor or manually enters a frequency or current command to an electronic drive for an electric motor to change the applied torque. Conversely, if too much torque is applied, the drill string 30 quickly rotates past the angle limits and manual adjustment is required.

Other disadvantages are associated with the prior technique. The operator enters the values for the angle limits through a user interface such as a keypad, graphical user interface and the like. Many operators, however, prefer to have hands-on control using simple knobs and switches. Moreover, the prior technique employs a custom angle sensor. The sensor becomes increasingly complex and expensive as the requirements for angular resolution and response time are increased. The speed and fidelity of response are inherently limited by the resolution and time delay of the sensor system. If the load torque changes because of a change in friction in the bore hole 34, the drill string 30 can suddenly change speed or may stop rotating completely, and the operator has to make a manual adjustment.

Another prior technique for performing directional drilling to address the above described problems is to alternate the torque applied by the motor between a higher value and a lower value. This method is advantageous because it does not rely on external position sensors, and the motor drive is controlled through a commonly available torque limit input. However, this method requires constant monitoring by the operator to adjust the torque limits to maintain the desired oscillatory motion. As drilling conditions change, the amount of torque change required to achieve a desired oscillation can vary substantailly and suddenly. In addition, this method does not conveniently support the application of torque in the reverse direction.

The method and system for directional drilling according to the invention eliminate the need for an external computer and expensive rotation sensors to monitor drill string rotation. Moreover, the method and system readily accommodate oscillatory control of the drill string 30 using controls and sensors that are integrated in a standard driller's control panel. Adjustable closed loop control of the rotation speed of the drill string 30 is provided throughout the oscillation cycle. An internal incremental rotation angle sensor in the top drive 26 (or other drill string motor) is used to estimate the rotation angle of the drill string 30. An averaged, or integrated, absolute angle is determined and used to ensure that the oscillations remain centered on the desired toolface orientation. Provisions are made to adjust the target rotation angle (i.e., "center position" of the drill string rotation) manually or for the use of electronic feedback from an MWD system to provide automated adjustment of the target rotation angle, if desired.

Figure 3:
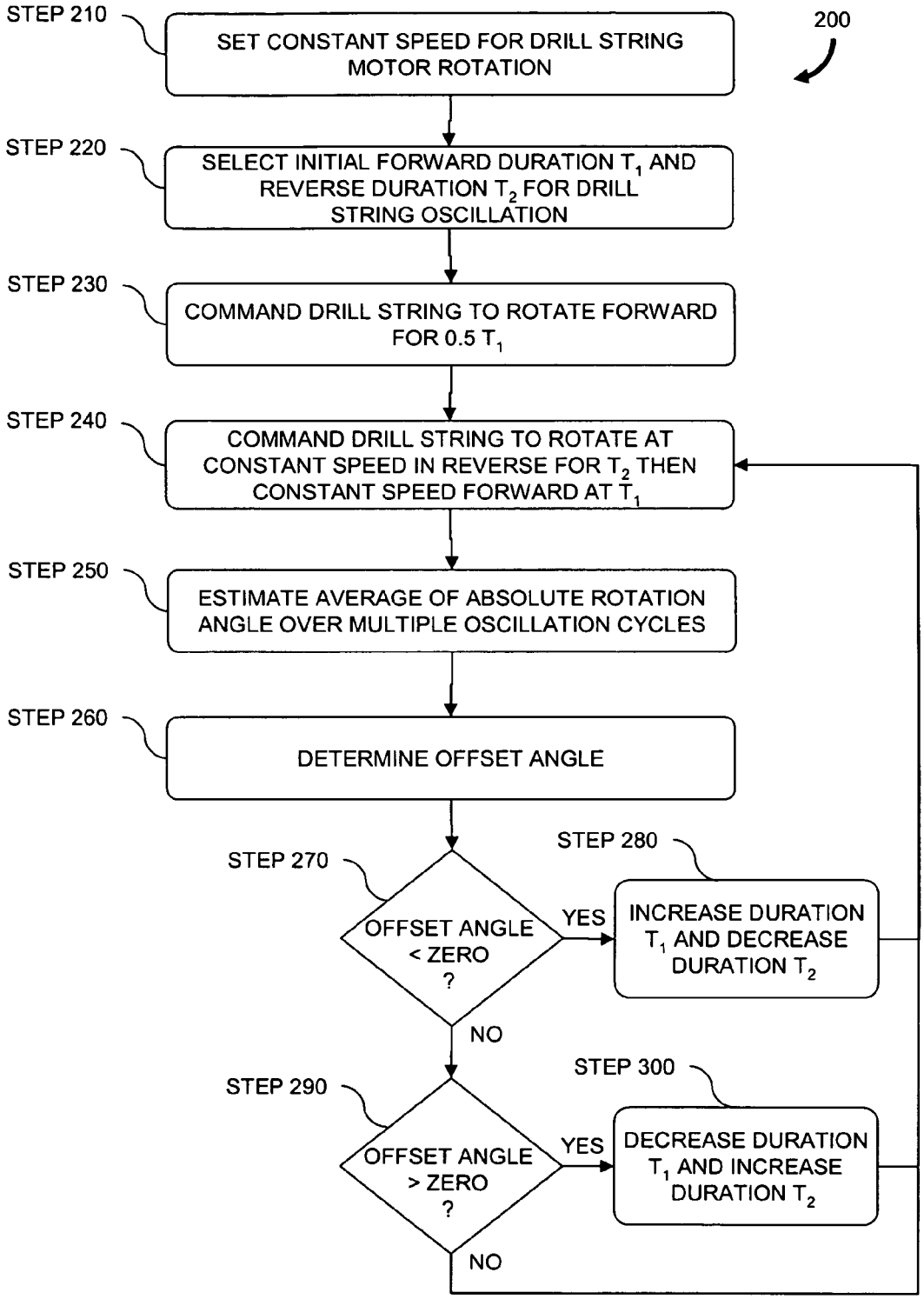
FIG. 3 is a flowchart representaton of an embodiment of a method for directional drilling in accordance with the invention.

FIG. 3 is a flowchart depicting an embodiment of a method 200 for directional drilling according to the invention. Initially, a constant speed is selected (step 210) for the rotation of the drill string 30, and the forward duration $T_1$ and reverse duration $T_2$ for each oscillation cycle are selected (step 220). Generally, the durations $T_1$ and $T_2$ are set to equal values although, in some embodiments, the durations durations $T_1$ and $T_2$ can be set to unequal values with prior knowledge of frictional effects on the drill string 30. When the toolface is oriented in the desired direction, the drill string 30 is commanded (step 230) to rotate in the forward direction for one half the time of the forward duration $T_1$. Subsequently, the drill string 30 is commanded (step 240) to rotate in the reverse and forward directions for durations $T_2$ and $T_1$, respectively, of equal time.

Figure 4:
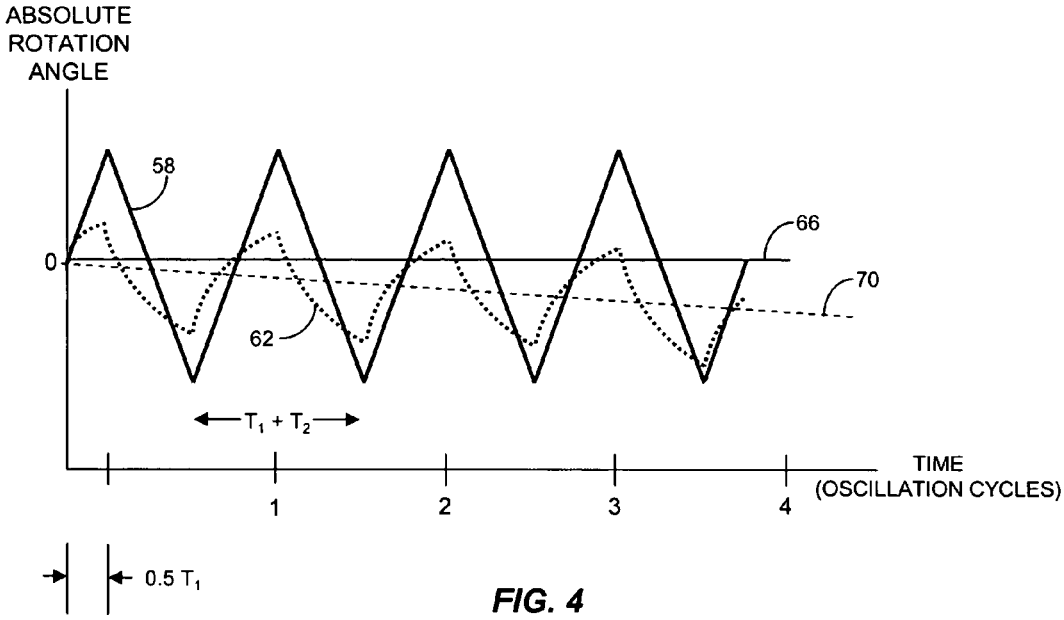
FIG. 4 is a graphical representation of absolute rotation angle as a function of time for an ideal drill string having zero rotational offset and a drill string with increasing rotational offset.

The commanded rotation is graphically depicted by the triangular waveform 58 in FIG. 4. The absolute rotation angle of the drill string 30 at the rig 10 is estimated from a rotation sensor on the top drive 26 or drill string motor as described in more detail below and is shown by the dashed waveform 62. A typical oscillation includes many revolutions of the drill string 30 in both the forward and reverse directions. As a result, the maximum and minimum values of the absolute rotation angle can be many thousands of degrees. For example, a drill string 30 that rotates forward 20 revolutions and then in reverse for 20 revolutions will have maximum and minimum absolute rotation angles of 3,600° and −3,600°, respectively. An oscillation segement as used herein means a portion of an oscillation cycle during which the drill string 30 rotates in a single direction. Oscillation segments of the actual rotation are typically non-linear due to the inability of the drill string motor to maintain constant speed throughout each segment because of reactive torques.

The absolute rotation angle is integrated over time for several oscillation cycles to estimate (step 250) the averaged absolute angle. In one embodiment, the maximum and minimum absolute rotation angles are sampled for each oscillation cycle and used to estimate the averaged absolute angle. An offset angle is determined (step 260) as the difference of the averaged absolute angle and the target rotation angle. If the toolface was correctly oriented prior to the start of the method 200, the target rotation angle is zero and, therefore, any non-zero offset angle is undesireable. Lines 66 and 70 in FIG. 4 represents the averaged absolute angle for drill string oscillation with "symmetric" rotation and center angle drift, respectively. The increasing separation in time between the lines 66, 70 indicates the increasing offset angle in time.

If it is determined (step 270) that the offset angle is less than zero, the durations $T_1$ and $T_2$ are adjusted (step 280) to compensate for the difference and the method 200 returns to step 240 for continued drilling. More specifically, the first duration $T_1$ is increased by a time interval $\Delta T$ for additional rotation in the forward direction and the second duration $T_2$ is decreased by the same time interval $\Delta T$. The value of the time interval $\Delta T$ is dependent on the value of the offset angle. Similarly, if it is determined (step 290) that the offset angle is greater than zero, the durations $T_1$ and $T_2$ are adjusted (step 300) to compensate for the difference and the method 200 returns to step 240 for continued drilling. More specifically, the first duration $T_1$ is decreased by a time interval $\Delta T$ and the second duration $T_2$ is increased by the same time interval $\Delta T$ for additional rotation in the reverse direction. If the offset angle is zero or has a value within a tolerance determined not to affect directional drilling accuracy, no adjustments are made to the the durations $T_1$ and $T_2$, and the method 200 returns to step 240.

Figure 5:
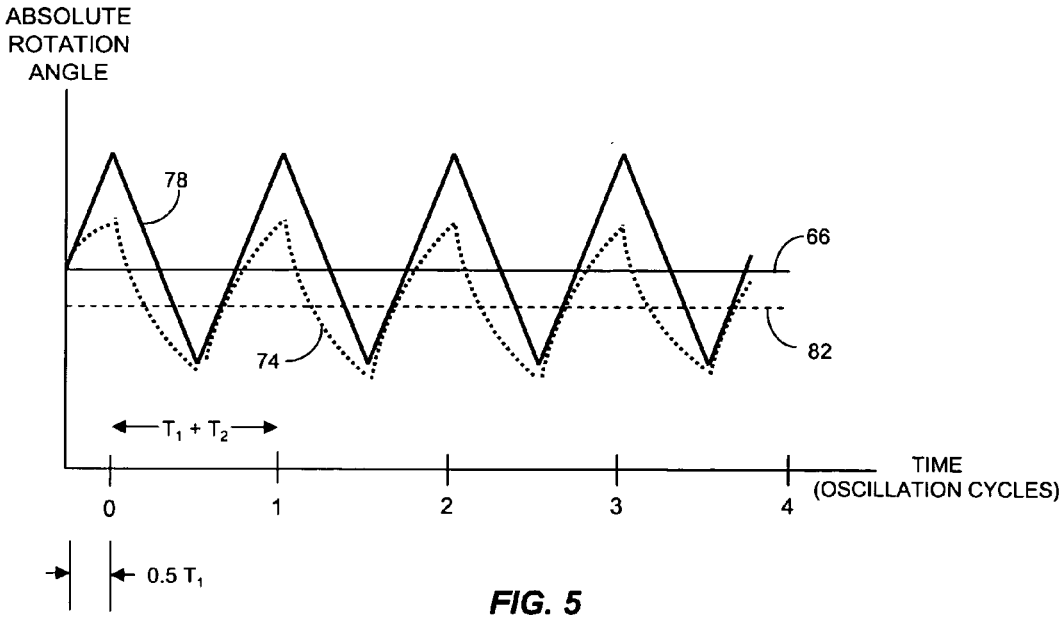
FIG. 5 is a graphical representation of absolute rotation angle as a function of time for an ideal drill string having zero rotational offset and a drill string with a static rotational offset.

FIG. 5 shows another example of absolute rotation angle represented by dashed waveform 74 resulting from a commanded rotation represented by triangular waveform 78. In this example, the averaged absolute angle shown as line 82 does not increase with time but is offset from the target rotation angle shown as line 66. The non-zero value of the offset angle results in adjustment to the durations $T_1$ and $T_2$ performed in step 280 of the method 200 of FIG. 3; however, because the offset angle is not time dependent, the adjustments to the durations $T_1$ and $T_2$ are only temporary. When the offset angle decreases to approximately zero, the durations $T_1$ and $T_2$ return to equal values.

Figure 6:
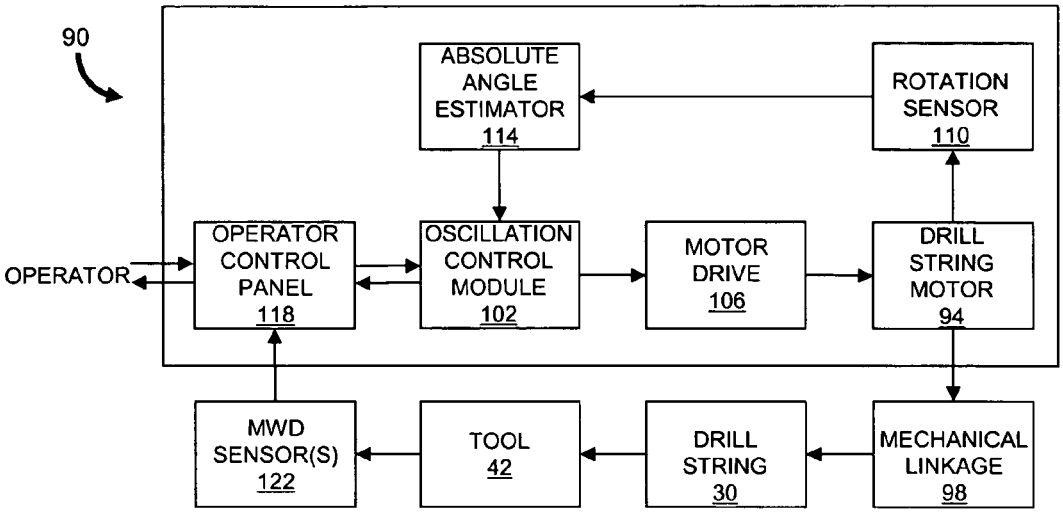
FIG. 6 is a block diagram of an embodiment of a system for directional drilling in accordance with the principles of the invention.

Referring to the functional block diagram of FIG. 6, an embodiment of a system 90 for directional drilling constructed in accordance with the invention includes multiple components used to rotate a drill string 30 in a controlled manner. The system 90 includes a drill string motor 94 which is coupled to the drill string 30 through a mechanical linkage 98. In one embodiment, the motor 94 is a synchronous electric AC permanent magnet motor. In other embodiments, an AC induction motor or DC motor is used. The mechanical linkage 98 can be a speed-reducing gearbox which, for example, rotates the drill string 30 once for every ten rotations of the motor 94. An oscillation control module 102 provides commands to a motor drive 106 for closed loop speed control of motor operation. In one embodiment, the motor drive 106 includes a power stage such as an electronic variable frequency drive (VFD) with software implemented controls using digital signal processors (DSPs). A rotation sensor 110 integral to the motor 94 or disposed adjacent to the motor 94 is used to monitor the rotation angle of the motor 94. Alternatively, the rotation sensor 110 can monitor rotation, for example, by determining rotation of mechanical components between the mechanical linkage 98 and drill string 30. The rotation sensor 110 can be, by way of example, a hall effect sensor, optical encoder, resolver, or incremental encoder as are known in the art. An absolute angle estimator 114 communicates with the sensor 110 and provides data indicating the absolute rotation angle of the drill string 30 to the oscillation control module 102. The oscillation control module 102 also receives commands and/or signals from an operator control panel 118.

To commence directional drilling, an operator first adjusts the orientation of the toolface, if necessary. Once the toolface orientation is correct, the operator enters the desired constant speed, oscillation magnitude, and durations $T_1$ and $T_2$ using the operator control panel 118. The oscillation control module 102 formats and forwards the commands to the motor drive 106 for closed loop speed control operation of the motor 94 in the desired manner. Advantageously, the low bandwidth utilized in controlling the oscillatory motion is easily implemented in the oscillation control module 102. The rotation sensor 110 provides an analog or digital signal indicative of the rotation angle of the drill string 30 to the absolute angle estimator 114. Although the rotation sensor 110 can be limited to detecting rotation through only 360°, the maximum and minimum absolute rotation angles of the drill string 30 are generally based on multiple rotations. Thus the absolute angle estimator 114 monitors the rotation angle of the drill string 30 to determine the absolute rotation angle of the drill string 30. The oscillation control module 102 receives the absolute angular rotation angle and provides a signal to the control panel 118 for displaying the absolute rotation angle to the operator. For example, the operator can monitor the current absolute rotation angle by observing a display device such as a meter on the control panel 118. Over time, the meter needle sweeps back and forth according to the achieved oscillatory motion. Using position and orientation data provided by MWD sensors 122 and displayed on the operator control panel 118, the operator determines whether to adjust the center of oscillation. If necessary, the operator makes the adjustment by temporarily altering the forward and reverse durations $T_1$ and $T_2$. The operator can make other changes to operational parameters such as the constant speed and the oscillation amplitude.

Figure 7:
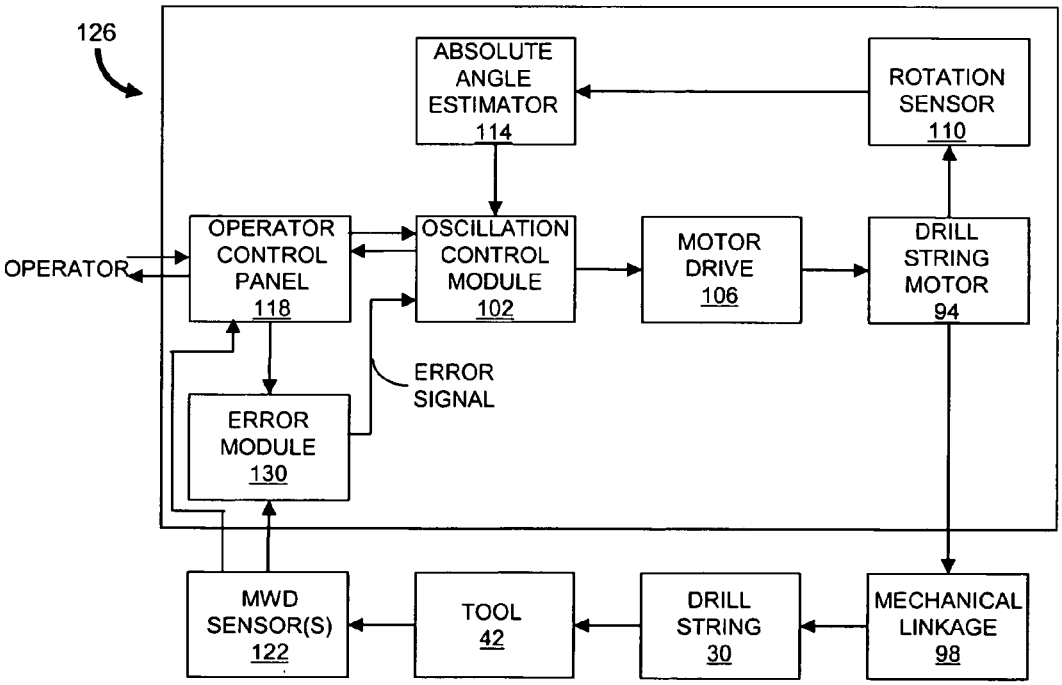
FIG. 7 is a block diagram of another embodiment of a system for directional drilling in accordance with the principles of the invention.

Referring to FIG. 7, another embodiment of a system 126 for directional drilling includes the components described in FIG. 6 plus an error module 130 in communication with the oscillation control module 102, operator control panel 118 and MWD sensors 122. The system 126 provides for automatic adjustment of oscillation parameters such as the forward and reverse durations $T_1$ and $T_2$. More specifically, MWD sensor data and the target rotation angle are provided to the error module 130. An error signal proportional to the difference between the MWD orientation data and the target rotaton angle is generated. The oscillation control module 102 increases one and decreases the other of the forward and reverse durations $T_1$ and $T_2$ according to the amplitude and polarity of the error signal.

While the invention has been shown and described with reference to specific preferred embodiments, it should be understood by those skilled in the art that various changes in form and detail can be made therein without departing from the spirit and scope of the invention as defined by the following claims.

What is claimed is:

1. A method for reducing friction in a bore hole during directional drilling, the method comprising commanding a motor to rotate a drill string at a constant speed in a forward direction and the constant speed in a reverse direction for a first duration and a second duration, respectively, for at least one oscillation cycle wherein an averaged absolute angle of the drill string is substantially the same as a target rotation angle for the drill string.

2. The method of claim 1 wherein the constant speed is maintained by closed loop speed control.

3. The method of claim 1 wherein the first duration and the second duration are equal durations.

4. The method of claim 1 further comprising modifying the target rotation angle for the drill string in response to measurement while drilling data.

5. The method of claim 1 further comprising:

determining the averaged absolute angle of the drill string for the at least one oscillation cycle;

determining a difference between the averaged absolute angle and the target rotation angle;

adjusting the first duration and the second duration in response to the difference; and commanding the motor to rotate the drill string at the constant speed in the forward direction and the reverse direction for the adjusted first duration and the adjusted second duration, respectively, for at least one subsequent oscillation cycle.

6. The method of claim 5 wherein determining the averaged absolute angle comprises integrating data indicative of the absolute rotation angle of the motor sampled at a plurality of times during the at least one oscillation cycle.

7. The method of claim 5 wherein determining the averaged absolute angle comprises determining a maximum absolute rotation angle and a minimum absolute rotation angle for each of a plurality of oscillation cycles.

8. The method of claim 5 wherein the adjustments comprise an increase to one and a decrease to the other of the first and second durations.

9. The method of claim 8 wherein the adjustments are of equal magnitude.

10. A control system for directional drilling comprising:

a rotation sensor providing rotation data in response to a rotation angle of a drill string;

an absolute angle estimator in communication with the rotation sensor to receive the rotation data and determine an absolute rotation angle of the drill string in response thereto;

an oscillation control module in communication with the absolute angle estimator and having a closed loop speed controller, the oscillation control module commanding the drill string motor to rotate at, a constant speed in a forward direction and the constant speed in a reverse direction for a first duration and a second duration, respectively, for at least one oscillation cycle; and an operator control panel in communication with the oscillation control module and adapted to receive measurement while drilling data, the operator control panel having at least one user input device for an operator to adjust the first duration and the second duration for at least one subsequent oscillation cycle.

11. The control system of claim 10 wherein the oscillation module provides a signal to the operator control panel and wherein the operator control panel has a display to present the absolute rotation angle of the drill string to an operator in response to the signal.

12. The control system of claim 10 further comprising at least one measurement while drilling sensor in communication with the operator control panel.

13. A control system for directional drilling comprising:

a rotation sensor providing rotation data in response to a rotation angle of a drill string;

an absolute angle estimator in communication with the rotation sensor to receive the rotation data and determine an absolute rotation angle of the drill string in response thereto;

an error module configured to receive a target rotation angle and measurement while drilling data and to generate an error signal in response to a difference therebetween, the measurement while drilling data indicating the orientation of a toolface of a drilling tool; and an oscillation control module in communication with the absolute angle estimator and the error module and having a closed loop speed controller, the oscillation control module commanding the drill string motor to rotate at a constant speed in a forward direction and the constant speed in a reverse direction for a first duration and a second duration, respectively, for at least one oscillation cycle wherein the first duration and the second duration are responsive to the error signal.

14. The control system of claim 13 further comprising an operator control panel in communication with the oscillation control module and the error module, the operator control module providing at least one user input device to enable an operator to adjust the first duration and the second duration and to input a target rotation angle.

15. The control system of claim 14 wherein the operator control panel has a display to present the absolute rotation angle of the drill string to an operator.

16. The control system of claim 14 further comprising at least one measurement while drilling sensor in communication with the operator control panel.

* * * * *